US005893531A

United States Patent [19]

Taylor et al.

[11] Patent Number: 5,893,531

[45] Date of Patent: Apr. 13, 1999

[54] ROLL DISPENSER

[76] Inventors: Kevin R. Taylor, 37244 Swamp Rd., Prairieville, La. 70769; Kevin P. McCoy, 8996 Shadow Bluff, Denham Springs, La. 70726

[21] Appl. No.: 08/997,920

[22] Filed: Dec. 24, 1997

[51] Int. Cl.[6] ..... B65H 19/00

[52] U.S. Cl. ..... 242/598.6; 312/34.2

[58] Field of Search ..... 242/598, 598.5, 242/598.6; 312/34.2, 34.24

[56] References Cited

U.S. PATENT DOCUMENTS

| | | |
|---|---|---|
| 346,201 | 7/1886 | Hibarger . |
| 617,292 | 1/1899 | Kleiner et al. . |
| 2,039,065 | 4/1936 | De Mark . |
| 2,528,935 | 11/1950 | Williams . |
| 2,561,584 | 7/1951 | McDonald . |
| 2,576,526 | 11/1951 | Marchand . |
| 2,649,255 | 8/1953 | Smallen . |
| 2,955,893 | 10/1960 | Dorval . |
| 2,965,429 | 12/1960 | Stanger . |
| 3,062,606 | 11/1962 | Magrauth . |
| 3,167,368 | 1/1965 | Rozlog et al. . |
| 3,171,135 | 3/1965 | Polichio . |
| 3,271,090 | 9/1966 | Smithers . |
| 4,033,650 | 7/1977 | Alissandratos . |
| 4,124,259 | 11/1978 | Harris . |
| 4,444,359 | 4/1984 | Butler . |

*Primary Examiner*—John P. Darling

*Attorney, Agent, or Firm*—John F. Sieberth; R. Andrew Patty II

[57] ABSTRACT

A dispenser which comprises (a) a first housing portion which is formed from at least one wall, the first housing portion wall defining a first housing portion interior and a first housing portion opening which exposes the interior of the first housing portion interior to the exterior of the first housing portion; and (b) a second housing portion formed from at least one wall; wherein one side of the second housing portion wall is configured to receive at least one end of a shaft upon which dispensable material may be placed, the shaft when present being disposed relative to the second housing portion wall so that the longitudinal axis of the shaft is offset from a plane occupied by at least a portion of the second housing portion, and wherein the second housing portion is rotatably attached to the first housing portion so that the second housing portion may be rotated about a second housing portion rotational axis, whereby upon rotation of the second housing portion the shaft when present may be revealed and accessed and upon further rotation of the second housing portion the shaft when present may be disposed within the first housing portion interior and concealed from view through the first housing portion opening. This and other novel devices are disclosed which enable dispensation of rolled material, e.g., paper towels, toilet paper, plastic wrap, tin foil, wire, etc. while also enabling the user to conceal the roll of material from view when not in use.

23 Claims, 6 Drawing Sheets

ROLL DISPENSER

TECHNICAL FIELD

This invention relates to devices which dispense a roll of material, e.g., paper towels, toilet paper, plastic wrap, tin foil, wire, etc. which is wound upon a shaft or bar, and to devices which may conceal the roll of material from view when not in use.

BACKGROUND

A well know method of packaging products such as, e.g., paper products, involves rolling or winding the product about a shaft or bar in such a way that the product is rolled upon itself. The shaft or bar is typically disposed for rotation about its longitudinal axis so that, when a user pulls a loose end of the product, the shaft or bar rotates to unwind and dispense at least a portion of the product. Various devices exist for detachably receiving the rotatable shaft of the rolled product and for housing the rolled product. Typically, these devices only partially house the rolled product, leaving at least a portion of the rolled product visible and accessible to the user at all times. When the appearance of the housing device and the rolled product are not material, these devices perform a useful function. However, many known conventional housings fail to provide an adequate option to the user who wishes to conceal the rolled product when not in use and to have easy access to the product as needed. Thus, a need exists for a way to provide easy access to rolled product while also providing a way to conceal the product when not in use.

SUMMARY OF THE INVENTION

The present invention is deemed to fulfill this need in a highly efficient way by providing, among other things, a dispenser which comprises:

a) a first housing portion which is formed from at least one wall, the first housing portion wall defining a first housing portion interior and a first housing portion opening which exposes the interior of the first housing portion interior to the exterior of the first housing portion; and b) a second housing portion formed from at least one wall; wherein one side of the second housing portion wall is configured to receive at least one end, and preferably both ends, of a shaft upon which dispensable material may be placed. When so received, the shaft is disposed relative to the second housing portion wall so that the longitudinal axis of the shaft is offset from a plane occupied by at least a portion of the second housing portion. The second housing portion is rotatably attached to the first housing portion so that the second housing portion may be rotated about a second housing portion rotational axis, whereby upon rotation of the second housing portion the shaft when present may be revealed and accessed and upon further rotation of the second housing portion the shaft when present may be disposed within the first housing portion interior and concealed from view through the first housing portion opening.

Although not necessarily the case, the dispensable material (e.g., paper towels, toilet paper, plastic wrap, tin foil, wire, etc.) housed by this dispenser will typically be placed upon the shaft in the form of a roll or hollow shaft upon which the material has been wound, so that the roll or hollow shaft will rotate about its longitudinal axis when a free end of the material is pulled.

In another embodiment of this invention, the second housing portion wall defines a second housing portion interior and a second housing portion opening which exposes the second housing portion interior to the exterior of the second housing portion; the shaft when present is disposed within the second housing portion; the second housing portion is sized to be at least partially concentrically contained within the first housing portion; and the second housing portion is rotatably attachable to the first housing portion when contained therein so that the second housing portion may be rotated within the first housing portion about the rotational axis. Upon rotation of the second housing portion the contents of the second housing portion can be revealed and accessed through the first and second housing openings. Upon further rotation of the second housing portion the contents of the second housing portion can be concealed from view through the first housing portion opening.

These and other embodiments and features of the invention will become still further apparent from the ensuing description, appended claims and accompanying drawings.

BRIEF DESCRIPTION OF THE DRAWINGS

In each of the above figures, like numerals are used to refer to like or functionally like parts among the several figures.

DETAILED DESCRIPTION OF THE INVENTION

As may now be seen, this invention provides a highly efficient dispenser and method for dispensing rolls of material while also enabling the user to remove the roll of material from view when desired.

Figure 1A:
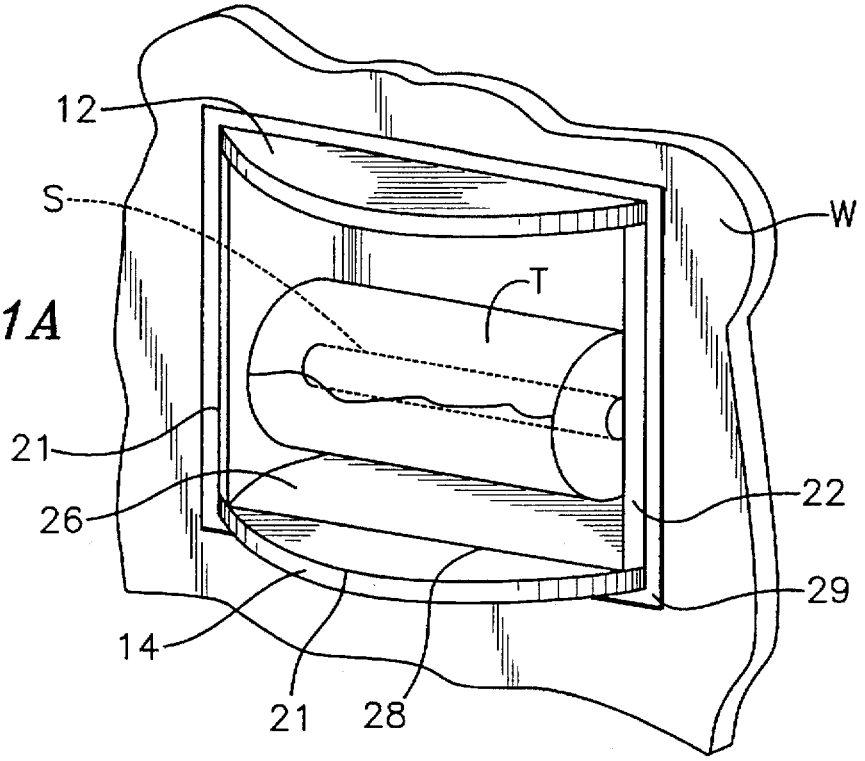
FIG. 1A is an elevated, partially phantom view in perspective of one embodiment of this invention in an open position.
Figure 1B:
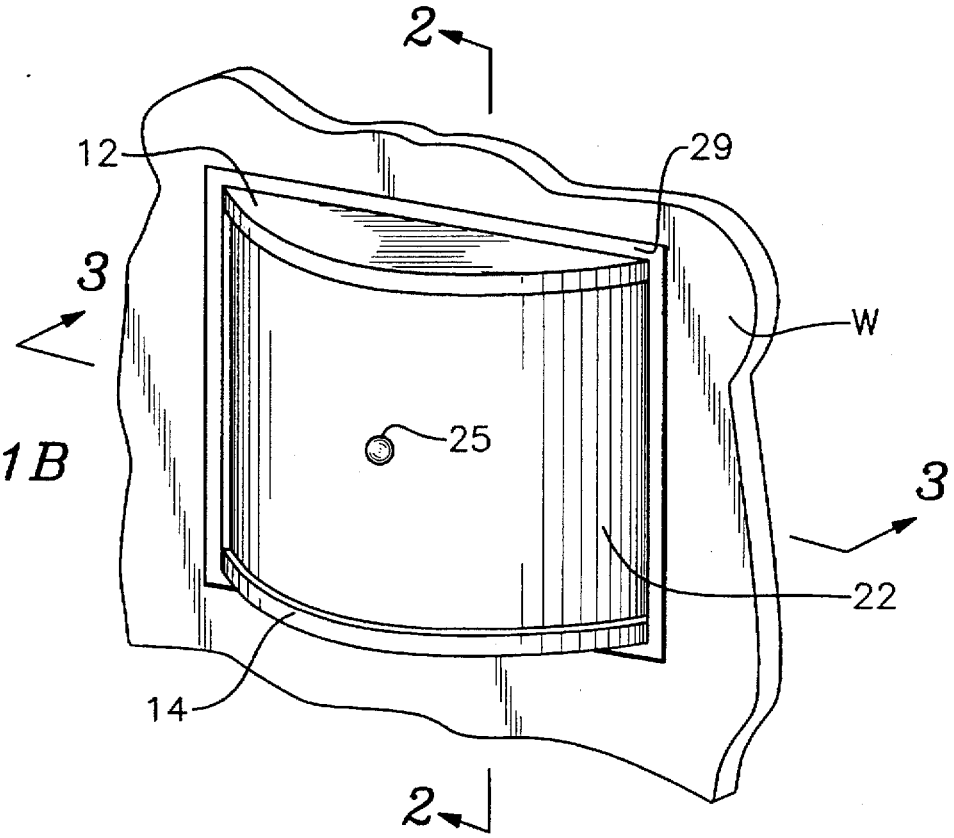
FIG. 1B is an elevated view in perspective of the dispenser of FIG. 1A in a closed position.

Referring now to the accompanying drawings, FIGS. 1A through 5 illustrate one preferred embodiment of this invention. The dispenser depicted is flush-mounted in a substantially vertical wall W, and comprises a first housing portion 10 formed by two substantially horizontal walls 12 and 14 and three substantially vertical walls 16, 17, and 18; a second housing portion 20 which is formed from an open curved, vertical wall 22, a substantially horizontal top wall 24 and a substantially horizontal bottom wall 26; and a shaft S upon which a roll of toilet tissue T is disposed so as to be rotatable about its longitudinal axis. First housing portion walls 12, 14, 16, 17, and 18 define a first housing portion interior 19, and walls 12, 14, 16 and 18 define a first housing portion opening 21 which exposes first housing portion interior 19 to the exterior of first housing portion 10. Walls 22, 24 and 26 form a second housing portion opening 28, revealing the contents of second housing portion 20. A decorative molding 29 extends from second housing portion 20 and around opening 21 so as to be flush with a wall W. A spring-loaded shaft S is disposed within second housing portion 20 by insertion of each end of shaft S into a respective bore 23 located in the interior surface of wall 22. Second housing portion 20 is substantially concentrically contained within first housing portion 10 and is rotatably connected to first housing portion 10 by two steel dowel pins 35, 35 extending through respective spacers 37,37 and into flange bearings 39,39 pressed into second housing portion 20. In this way, second housing portion 20 is rotatably attachable to first housing portion 10 so that second housing portion 20 may be rotated within first housing portion 10 at interior 19 and about a substantially vertical rotational axis A. The dispenser further comprises four cylindrical rare earth magnets 40 pressed into first housing portion 10 and corresponding carbon steel sheet metal screws 42 screwed into second housing portion 20 to provide resistance to excessive or undesirable rotation of second housing portion 20. A handle 25 (FIG. 1B) is attached to wall 22 to facilitate rotation of second housing portion 20. As seen in FIG. 1A, upon rotation of second housing portion 20, the contents thereof, namely shaft S and toilet tissue roll T, may be revealed and accessed through first and second housing openings 21 and 28, respectively. FIG. 1A illustrates the dispenser in an opened position. Also, as may be seen from FIG. 1B, upon further rotation of second housing portion 20, the contents of second housing portion 20 is concealed from view through second housing portion opening 28 by curved wall 22. FIG. 1B illustrates the dispenser in a closed position.

Figure 2:
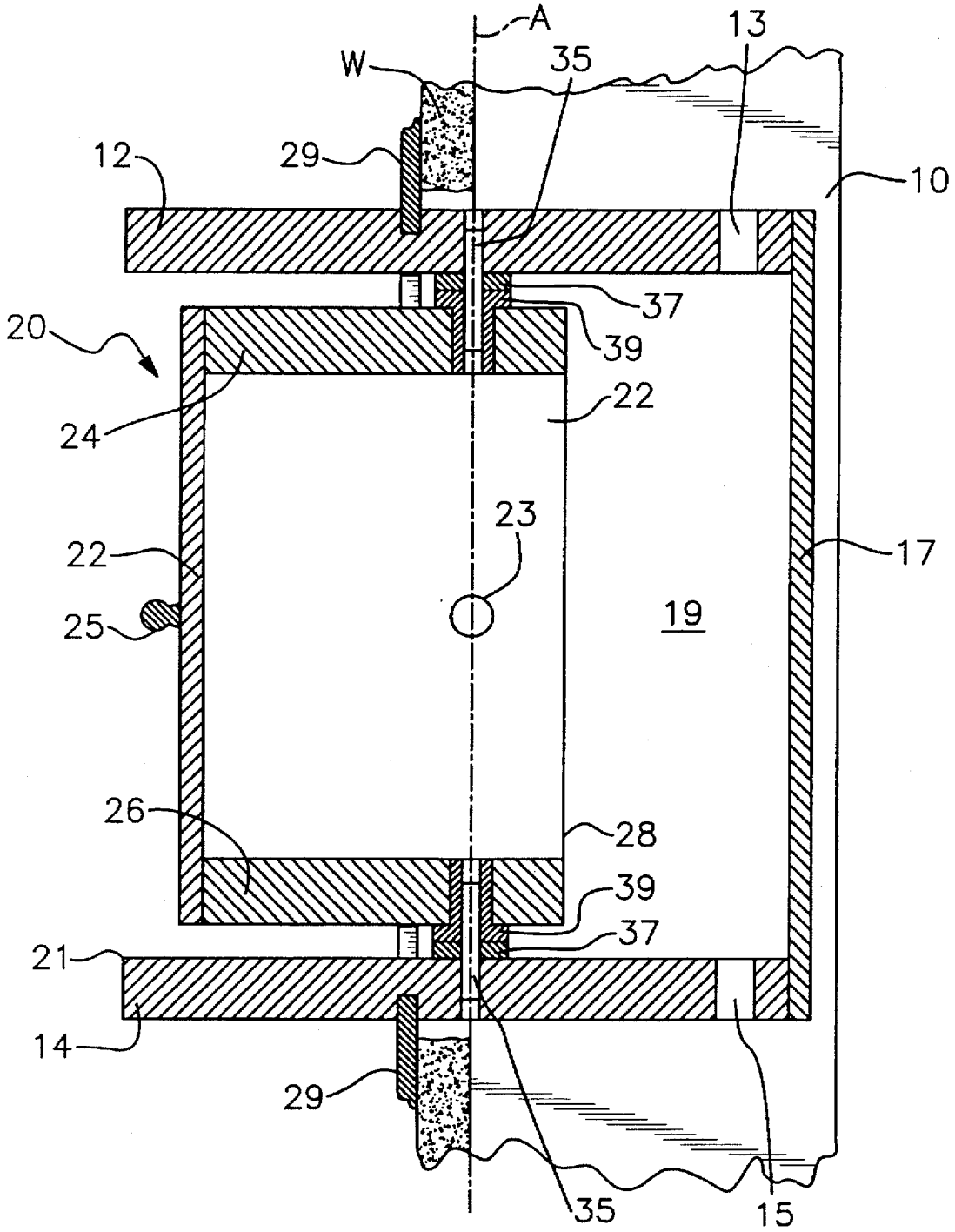
FIG. 2 is a side view in cross-section of the dispenser of FIGS. 1A and 1B, along the line indicated in FIG. 1B.
Figure 3:
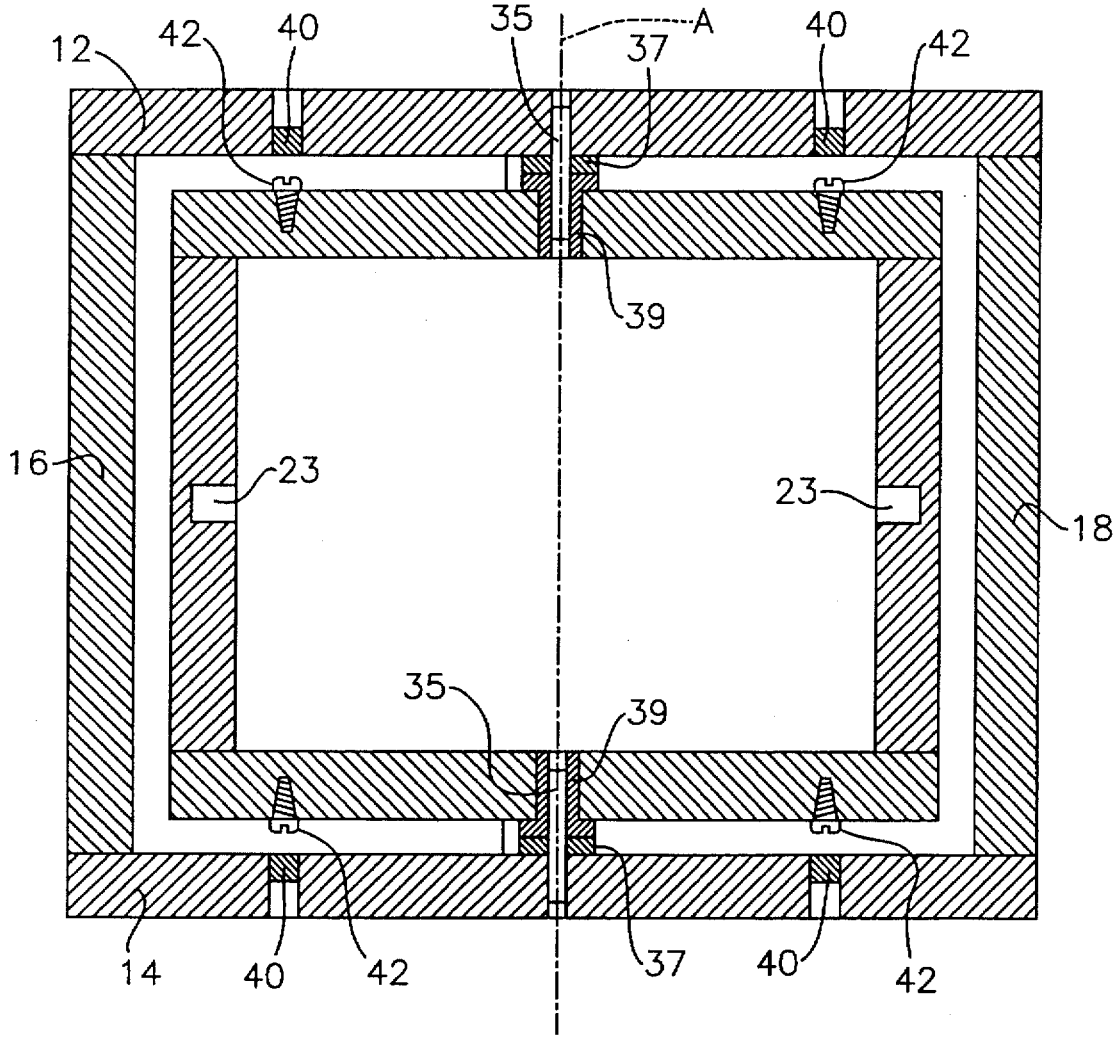
FIG. 3 front view in cross-section of the dispenser of FIGS. 1A and 1B, along the line indicated in FIG. 1B.

It should be noted that cross-sectional FIGS. 2 and 3 illustrate the dispenser of FIG. 1 with toilet tissue roll T and spring-loaded shaft S removed from the interior of second housing portion 20. Also, as may be seen on FIG. 2, the preferred dispenser depicted also includes two apertures 13 and 15 through walls 12 and 14, respectively. These apertures expose the heads of screws 42 when second housing portion 20 is appropriated rotated to allow access to one or more corresponding screws 42 for adjustment of the distance from the corresponding magnets 40 when the screw 42 is disposed proximate thereto. In this way, the holding strength of magnets 40 while in the dispenser open and dispenser closed positions may be adjusted as desired.

Figure 4:
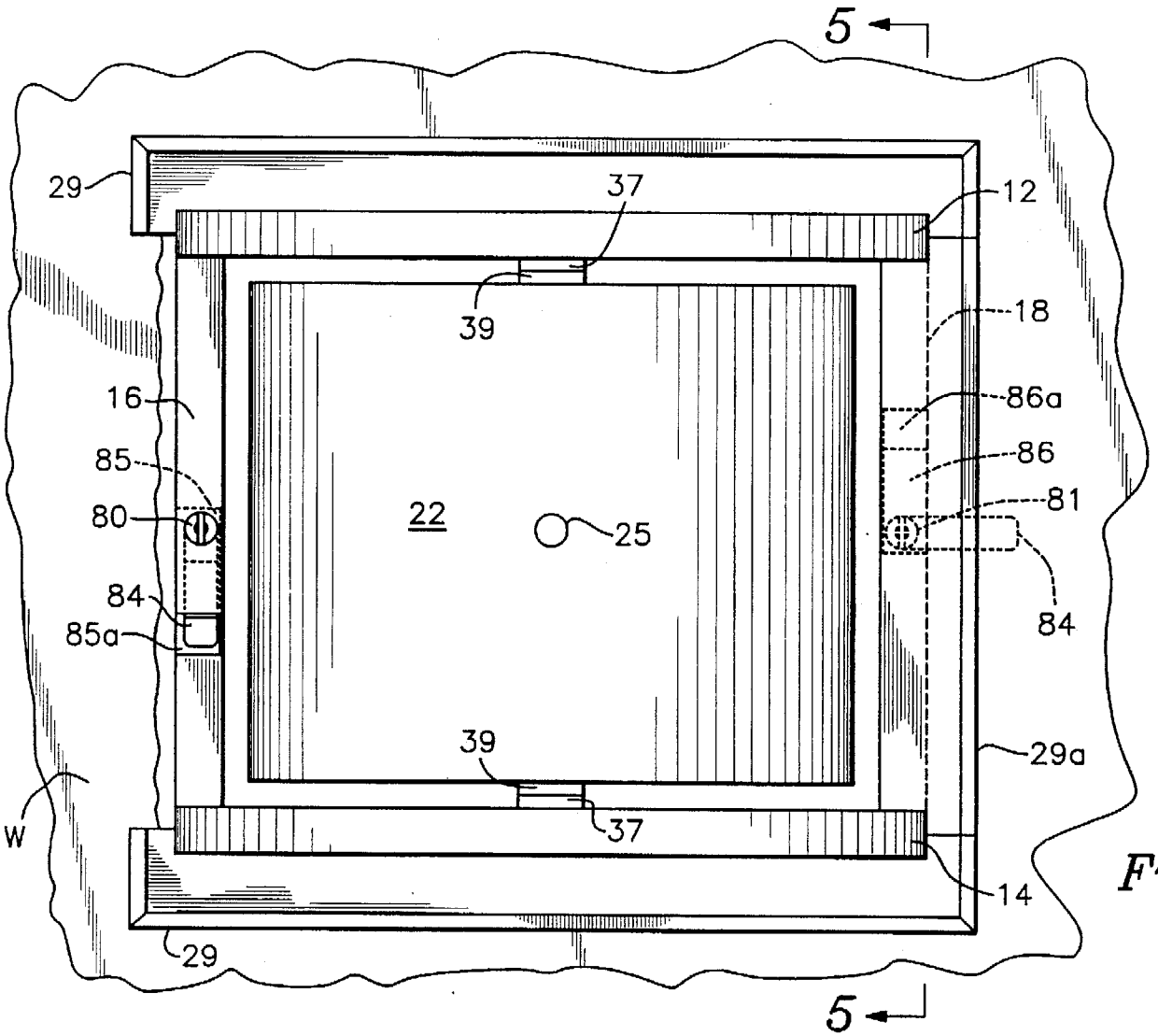
FIG. 4 is a side, partially phantom view of the dispenser of FIGS. 1A and 1B showing the mechanism for flush mounting the dispenser to a wall.
Figure 5:
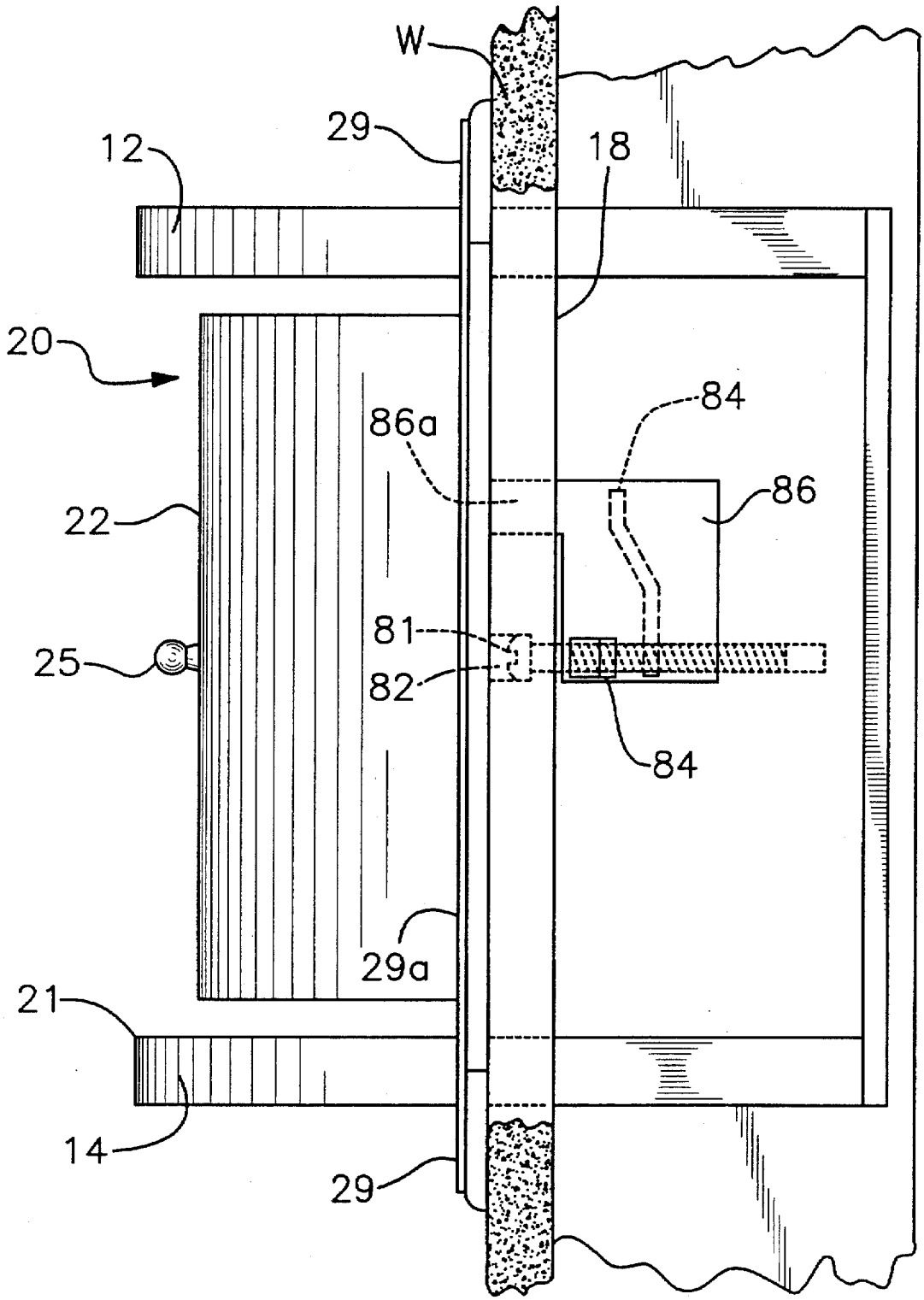
FIG. 5 is a front partially phantom view of the dispenser of FIGS. 1A and 1B partially disassembled and showing the mechanism for flush mounting the dispenser to a wall.

FIGS. 4 and 5 illustrate the mechanism by which the preferred dispenser of FIGS. 1A–3 is flush-mounted to wall W. Two threaded screws 80,81 are disposed in respective apertures 82 (only one shown on FIG. 5), each screw 81 and 82 being threadably engaged with a corresponding S-shaped flange 84 at a point proximate one end of the flange. Each flange 84 is nested within a respective recess 85 or 86 in wall 16 or 18, respectively. Recesses 85 and 86 include respective passages 85*a* and 86*a* which extend to the front edge of wall 16 and 18, respectively. Molding 29 comprises removable lateral molding portions 29*a* (only one shown on FIG. 4), which provide access to and coverage of screws 80 and 81. As may be seen from FIG. 4, recesses 85 and 86 are disposed substantially below and above a horizontal plane occupied by their respective screws 80 and 81. Such configuration is preferred when the screws 80 and 81 have right-turn threading for tightening the screws. Alternatively, the opposite disposition of the recesses is preferred when the screws have left-turn threading for tightening the screws. Passages 85*a* and 86*a* provide access to their respective flange 84 to permit the user to assist in lateral placement of the free end of each flange 84 so that the free end of each flange 84 contacts wall W when screws 80 and 81 are sufficiently tightened. The free end of each flange 84 is laterally disposed from the dispenser and screws 80 and 81 are sufficiently tightened, molding 29 and flanges 84 act to clamp wall W and to hold the dispenser in place and flush relative to wall W. FIG. 5 illustrates flange 84 in solid lines to show the position of flange 84 when the dispenser is installed, and in phantom lines to show the position of flange 84 in recess 86 when not in use. As may now be appreciated, upon tightening of screws 80 and 81, each flange 84 may be disposed to contact the outer surface of surrounding wall W and is urged against wall W while a portion of first housing portion 10, namely molding 29, is urged in an opposite direction against the interior surface of wall W. Upon loosening of screws 80 and 81, flanges 84 may be placed back into respective recesses 85 and 86 to facilitate removal of the dispenser through the hole in the surrounding wall. This preferred configuration for flush-mounting the dispenser enables the facile installation and removal of the dispenser from a wall without the use of toggle bolts or other similarly inconvenient means.

Figure 6:
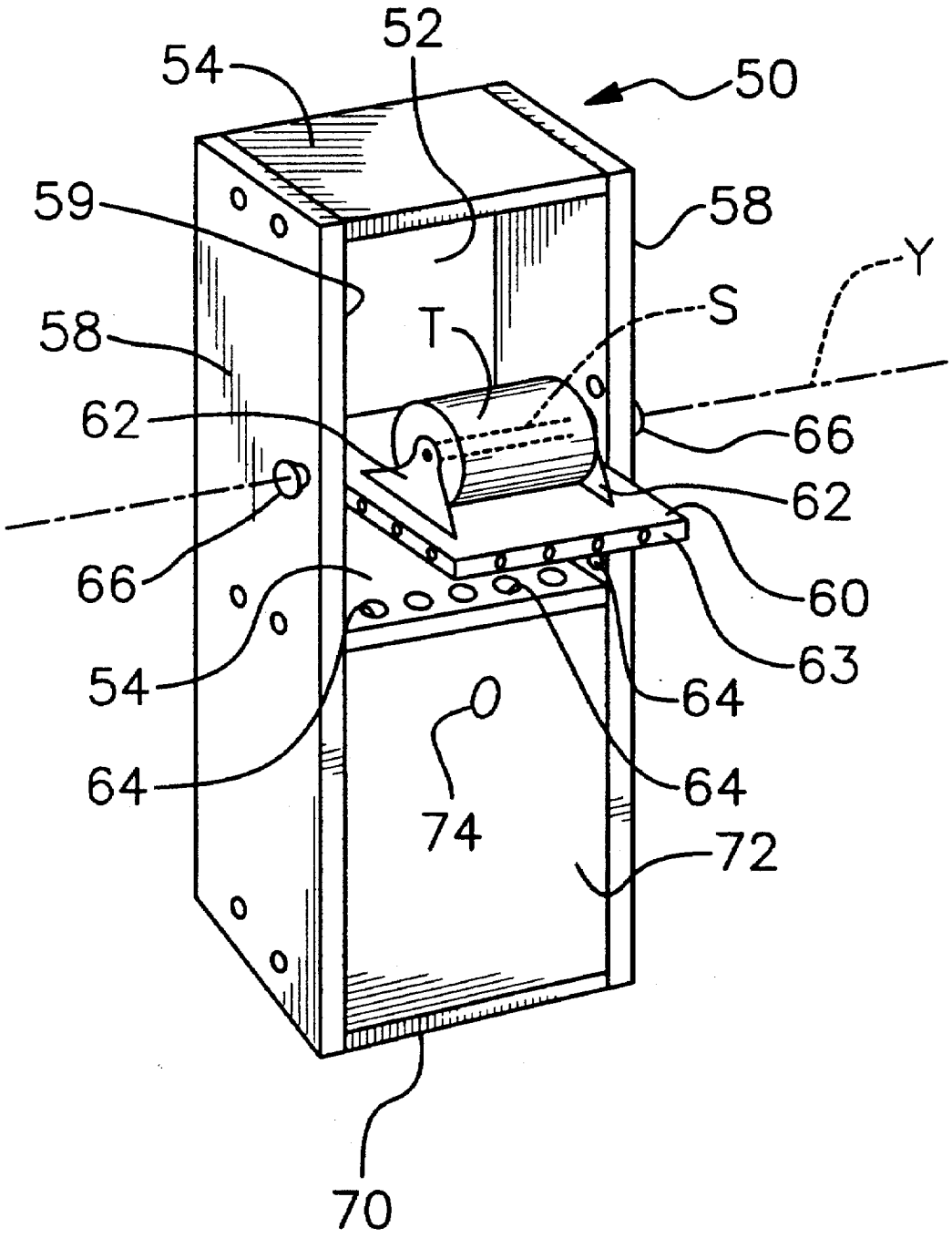
FIG. 6 is an elevated partially phantom view in perspective of another embodiment of this invention in a partially open position.

Another preferred embodiment of the invention is illustrated in FIG. 6. The dispenser depicted in FIG. 6 is a stand-alone unit, but those of ordinary skill in the art will appreciate that the dispenser depicted also may be attached to a substantially vertical wall or partially recessed within a substantially vertical wall, e.g., wall W of FIGS. 1A–5. The dispenser comprises a first housing portion 50 which is formed from a substantially vertical rear wall 52, a substantially horizontal top wall 54, a substantially horizontal bottom wall 56, and two substantially vertical lateral walls 58,58; a second housing portion defined by a rectangular, substantially planar wall 60 rotatably attached at opposite edges to each respective lateral wall 58; and a spring-loaded shaft S rotatably attached to brackets 62,62 which extend from one side of wall 60. Shaft S is disposed relative to second housing portion wall 60 so that the longitudinal axis of shaft S is offset from the plane occupied by wall 60. A roll of toilet tissue T is disposed upon shaft S, whereby roll T becomes rotatable about its longitudinal axis so that material can be easily unwound and removed therefrom. Walls 54, 56 and 58,58 form a first housing portion opening 59, revealing the contents of first housing portion 50. Wall 60 is sized and configured to substantially fill opening 59 when rotated into a substantially vertical position. A strip of metal 63 is attached to the outer edge of wall 60, and a plurality of cylindrical rare earth magnets 64 have been pressed into walls 56 and 58 about the outer edges of opening 59, whereby a resistance to further rotation of wall 60 about a second housing portion rotational axis Y which extends across opening 59 is provided when metal strip 63 is aligned with magnets 64. Two handles 66,66 are connected through respective walls 58,58 to opposite edges of wall 60 along rotational axis Y to better enable manual rotation of wall 60. As may now be appreciated, upon rotation of rectangular wall 60 about axis Y, toilet tissue roll T may be revealed and accessed when the side of wall 60 to which the roll T is attached is outside of first housing portion 50. Upon further rotation of wall 60, shaft S, and therefore roll T, may be placed within first housing portion 50 and concealed from view through first housing portion opening 59 by wall 60 itself.

In the preferred dispenser depicted in FIG. 6, second housing portion rotational axis Y is substantially horizontal during normal use, and the longitudinal axis of shaft S is substantially horizontal when it is received by second housing portion wall 60 and the dispenser is in normal use. In addition, an optional lower cabinet provides additional storage below the dispenser and is formed by walls 52 and 58,58, a bottom wall 70 and a door 72 hinged to wall 70. Door 72 is equipped with a handle 74 for access to the space formed by walls 52, 58,58, and 70.

The number of walls which form the first and second housing portions may vary widely, depending upon the desired shape of the housings. However, at least one wall is required to form each of the housings of the dispensers of this invention. Likewise, the dimensions of each of the components of dispensers of this invention may vary widely and do not constitute a limitation of this invention.

The various wall components of the dispenser of this invention may be fabricated from any number of conventional materials. Typically, the housing portions of the dispenser will be fabricated from wood, metal, metal alloy, plastic, or porcelain, for example, although various other materials could be used. Preferred materials include wood, plastic, and stainless steel for reasons of durability and ease of use. In addition, the second housing portion could be formed simply from a substantially vertical wall in which a recess is made for housing the second housing portion.

This invention is susceptible to considerable variation in its practice. Therefore, the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

What is claimed is:

1. A dispenser which comprises:

a) a first housing portion which is formed from at least one wall, the first housing portion wall defining a first housing portion interior and a first housing portion opening which exposes the interior of the first housing portion interior to the exterior of the first housing portion; and b) a second housing portion formed from at least one wall;

wherein one side of the second housing portion wall is configured to receive at least one end of a shaft upon which dispensable material may be placed, the shaft when so received being disposed relative to the second housing portion wall so that the longitudinal axis of the shaft is offset from a plane occupied by at least a portion of the second housing portion, and wherein the second housing portion is rotatably attached to the first housing portion so that the second housing portion may be rotated about a second housing portion rotational axis, whereby upon rotation of the second housing portion the shaft when present may be revealed and accessed and upon further rotation of the second housing portion the shaft when present may be disposed within the first housing portion interior and concealed from view through the first housing portion opening the dispenser further comprising at least one handle connected to the second housing portion to enable rotation of the second housing portion about its rotational axis.

2. A dispenser according to claim 1 wherein the second housing portion rotational axis extends across the first housing opening.

3. A dispenser according to claim 1 wherein the longitudinal axis of the shaft is substantially horizontally disposed when the end of the shaft is received by the second housing portion wall.

4. A dispenser according to claim 1 wherein the second housing portion is formed from one wall which is substantially planar.

5. A dispenser according to claim 4 wherein the first housing portion is formed from a top wall, a bottom wall, and three side walls extending between the top and bottom walls.

6. A dispenser according to claim 5 wherein the second housing portion rotational axis is substantially horizontal during normal use of the dispenser.

7. A dispenser according to claim 6 wherein the longitudinal axis of the shaft is substantially horizontal when the shaft is received by the second housing portion wall and the dispenser is in normal use.

8. A dispenser according to claim 1 wherein the first housing portion is flush-mountable to a vertical surface.

9. A dispenser according to claim 1 wherein the second housing wall is configured to receive both ends of the shaft.

10. A dispenser according to claim 9 wherein the longitudinal axis of the shaft is substantially horizontally disposed when the ends of the shaft are received by the second housing wall.

11. A dispenser which comprises:

a) a first housing portion which is formed from at least one wall, the first housing portion wall defining a first housing portion interior and a first housing portion opening which exposes the interior of the first housing portion interior to the exterior of the first housing portion; and b) a second housing portion which is substantially cylindrical in shape and is formed from a substantially horizontal top wall, a substantially horizontal bottom wall, and an intermediate curved wall vertically extending between the top and bottom walls;

wherein one side of one of the second housing portion walls is configured to receive at least one end of a shaft upon which dispensable material may be placed the shaft when so received being disposed relative to the one of the second housing portion walls so that the longitudinal axis of the shaft is offset from a plane occupied by at least a portion of the second housing portion and wherein the second housing portion is rotatably attached to the first housing portion so that the second housing portion may be rotated about a second housing portion rotational axis, whereby upon rotation of the second housing portion the shaft when present may be revealed and accessed and upon further rotation of the second housing portion the shaft when present may be disposed within the first housing portion interior and concealed from view through the first housing portion opening.

12. A dispenser according to claim 11 wherein the first housing portion is flush-mountable to a vertical surface.

13. A dispenser according to claim 11 wherein the one side of one of the second housing portion walls is configured to receive both ends of the shaft.

14. A dispenser which comprises:

a) a first housing portion which is formed from at least one wall, the first housing portion wall defining a first housing portion interior and a first housing portion opening which exposes the interior of the first housing portion interior to the exterior of the first housing portion; and b) a second housing portion formed from at least one wall which defines a second housing portion interior and a second housing portion opening which exposes the second housing portion interior to the exterior of the second housing portion, said second housing portion being sized to be at least partially concentrically contained within the first housing portion;

wherein one side of the second housing portion wall is configured to receive at least one end of a shaft upon which dispensable material may be placed, the shaft when so received being disposed within the second housing portion and disposed relative to the second housing portion wall so that the longitudinal axis of the shaft is offset from a plane occupied by at least a portion of the second housing portion, and wherein the second housing portion is rotatably attachable to the first housing portion when contained therein so that the second housing portion may be rotated within the first housing portion about a second housing portion rotational axis, whereby upon rotation of the second housing portion the contents of the second housing portion may be revealed and accessed through the first and second housing openings and upon further rotation of the second housing portion the contents of the second housing portion can be concealed from view through the first housing opening.

15. A dispenser according to claim 14 wherein the first housing portion is flush-mountable to a vertical surface.

16. A dispenser according to claim 15 wherein the second housing portion is substantially cylindrical in shape and is formed from a substantially horizontal top wall, a substantially horizontal bottom wall, and an intermediate curved wall vertically extending between the top and bottom walls.

17. A dispenser according to claim 16 wherein the second housing wall is configured to receive both ends of the shaft.

18. A dispenser according to claim 17 wherein the longitudinal axis of the shaft is substantially horizontally disposed when the ends of the shaft are received by the second housing wall and the dispenser is in normal use.

19. A dispenser according to claim 18 wherein the longitudinal axis of the shaft is substantially horizontally disposed when the end of the shaft is received by the second housing wall and the dispenser is in normal use.

20. A dispenser according to claim 14 wherein the second housing portion is substantially cylindrical in shape and is formed from a substantially horizontal top wall, a substantially horizontal bottom wall, and an intermediate curved wall vertically extending between the top and bottom walls.

21. A dispenser according to claim 14 wherein the second housing wall is configured to receive both ends of the shaft.

22. A dispenser according to claim 14 wherein the longitudinal axis of the shaft is substantially horizontally disposed when the end of the shaft is received by the second housing wall and the dispenser is in normal use.

23. A dispenser which comprises:

a) a first housing portion which is formed from at least one wall the first housing portion wall defining a first housing portion interior and a first housing portion opening which exposes the interior of the first housing portion interior to the exterior of the first housing portion;

b) a second housing portion formed from at least one wall; and c) two flanges threadably attached to respective screws, the screws extending through the first housing portion, each of the flanges being disposed within a respective recess in the first housing portion, whereby upon tightening of the screws, the flanges may be disposed to contact one side of a surrounding wall and are urged in one direction while a portion of the first housing portion is urged in an opposite direction and into contact with the other side of the surrounding wall, and whereby upon loosening of the screws, each flange may be placed back into its respective recess;

wherein one side of the second housing portion wall is configured to receive at least one end of a shaft upon which dispensable material may be placed the shaft when so received being disposed relative to the second housing portion wall so that the longitudinal axis of the shaft is offset from a plane occupied by at least a portion of the second housing portion, and wherein the second housing portion is rotatably attached to the first housing portion so that the second housing portion may be rotated about a second housing portion rotational axis, whereby upon rotation of the second housing portion the shaft when present may be revealed and accessed and upon further rotation of the second housing portion the shaft when present may be disposed within the first housing portion interior and concealed from view through the first housing portion opening.

* * * * *